US005249778A

United States Patent [19]

Steichert et al.

[11] Patent Number: 5,249,778

[45] Date of Patent: Oct. 5, 1993

[54] GAS STIR PLUG DEVICE WITH VISUAL WEAR INDICATOR

[75] Inventors: Wolfgang Steichert, Kresfeld; Dieter Vahlhaus, Muhlheim an der Ruhr, both of Fed. Rep. of Germany

[73] Assignee: Dolomitwerke GmbH, Wulfrath, Fed. Rep. of Germany

[21] Appl. No.: 868,598

[22] Filed: Apr. 14, 1992

[51] Int. Cl.[5] ..... B22D 1/00

[52] U.S. Cl. ..... 266/99; 266/220

[58] Field of Search ..... 266/44, 280, 220, 275, 266/217, 99

[56] References Cited

U.S. PATENT DOCUMENTS

| | | | |
|---|---|---|---|
| 4,438,907 | 3/1984 | Kimura et al. | 266/217 |
| 4,481,809 | 11/1984 | LaBate | 73/86 |
| 4,535,975 | 8/1985 | Buhrmann et al. | 266/220 |
| 4,539,043 | 9/1985 | Miyawaki et al. | 266/265 |
| 4,560,149 | 12/1985 | Hoffgen | 266/220 |
| 4,647,020 | 3/1987 | Liesch et al. | 266/270 |
| 4,657,226 | 4/1987 | Illemann et al. | 266/220 |
| 4,741,515 | 5/1988 | Sharma et al. | 266/266 |
| 4,744,544 | 5/1988 | LaBate et al. | 266/100 |
| 4,836,433 | 6/1989 | Perri | 266/266 |
| 4,840,356 | 6/1989 | LaBate | 266/265 |
| 4,858,894 | 8/1989 | LaBate | 266/265 |
| 4,884,787 | 12/1989 | Dotsch et al. | 266/270 |
| 4,898,369 | 2/1990 | Perri | 266/266 |
| 4,899,992 | 2/1990 | Thrower et al. | 266/44 |
| 4,905,971 | 3/1990 | Rothfuss et al. | 266/266 |
| 4,925,166 | 5/1990 | Zimmermann | 266/270 |
| 4,991,825 | 2/1991 | Struzik et al. | 266/217 |
| 5,127,632 | 7/1992 | Muschner et al. | 266/220 |

FOREIGN PATENT DOCUMENTS

| | | |
|---|---|---|
| 3424466 | 1/1985 | Fed. Rep. of Germany . |
| 3526391 | 2/1987 | Fed. Rep. of Germany . |
| 3538498 | 5/1987 | Fed. Rep. of Germany . |
| 3625117 | 11/1987 | Fed. Rep. of Germany . |
| 3623609 | 1/1988 | Fed. Rep. of Germany . |
| 3802657 | 9/1989 | Fed. Rep. of Germany . |
| 3833503 | 10/1990 | Fed. Rep. of Germany . |

*Primary Examiner*—Scott Kastler

*Attorney, Agent, or Firm*—Caesar, Rivise, Bernstein, Cohen, & Pokotilow, Ltd.

[57] ABSTRACT

A stir plug of frusto-conical shape for introducing gas into a mass of molten metal and comprising a plug having an outer core formed of a first refractory material. A wear indicator in the form of a central core comprised of a second refractory material is located within a centrally located recess in the outer core adjacent the bottom end of the plug. The central core extends from the bottom end of the plug towards the top end of the plug and is of a predetermined height less than that of the outer core. The upper end of the central core when exposed by the erosion of the stirring plug provides a visual indication of when that plug should be replaced.

12 Claims, 2 Drawing Sheets

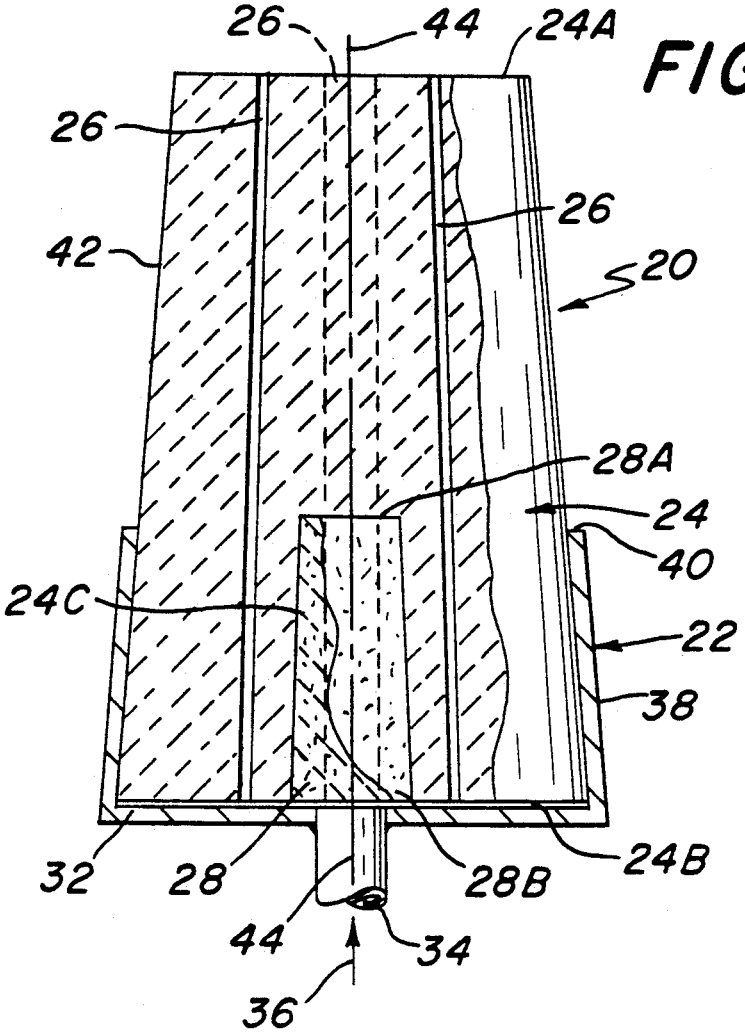
FIG. 1
FIG. 7
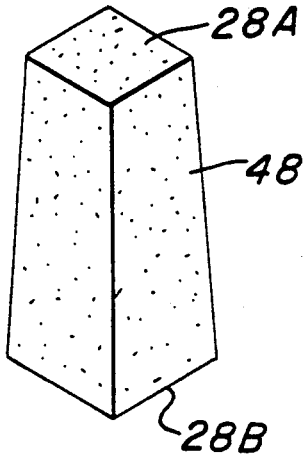
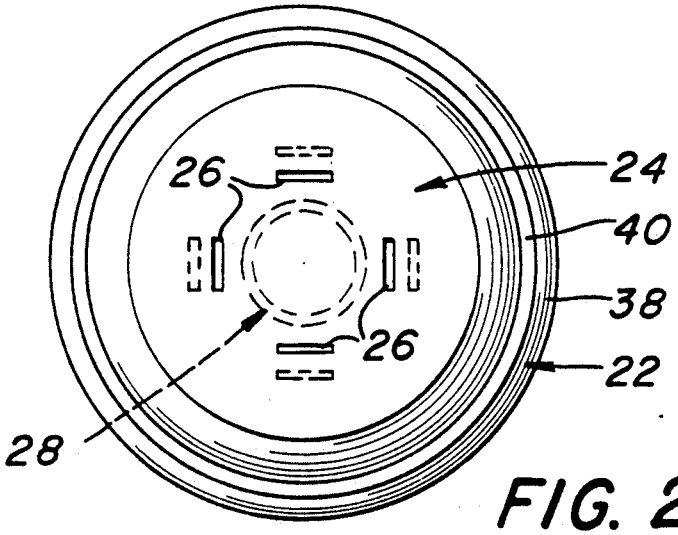
FIG. 2

GAS STIR PLUG DEVICE WITH VISUAL WEAR INDICATOR

BACKGROUND OF THE INVENTION

This invention relates generally to devices for insufflating gas into a mass of molten metal such as steel, and more specifically, to an optical wear indicator that indicates when the device should be replaced.

The making of steel or other metals typically involves the introduction of gases into the ladle or vessel holding the molten metal to stir it. The gas is typically introduced into the ladle via a device called a stir plug. Such a stir plug may be mounted in the bottom or side of the vessel. Prior art stir plugs have taken numerous forms and constructions.

For example, one common type of stir plug comprises a solid, non-gas-permeable, conical refractory member disposed within a loose fitting metal or ceramic shell or canister. Such a "canistered" plug is commonly disposed within a seating block in the wall, e.g., the bottom, of the vessel holding the molten metal, and the purging gas is transported through the gap between the refractory cone and the metal canister into the molten metal.

Another common type of stir plug comprises a conical shaped member or plug formed of a porous refractory material through which the purging (stirring) gas is passed to produce fine gas bubbles to stir the molten metal. Thus, that type of plug utilizes the porosity of the material forming the plug to create a capillary system formed by the interstitial spaces between the porous material for carrying the stirring gas through the plug. Such plugs are commonly disposed within a seating block in the wall such as the bottom of the vessel.

Another type of uncanistered plug is the so-called directed porosity plug. That plug comprises a conical body of cast refractory material containing an array of fine (0.7 mm diameter) channels that run in a straight line from the bottom to the top of the plug. When these plugs are used, the gas is distributed very finely in the molten metal by means of the capillaries, but as it passes through the capillaries, it undergoes a very high degree of friction loss as a result of the turbulence which develops on the inside surfaces of the capillaries. The effects of this turbulence on the flow of gas decreases with increasing size of the capillary cross section. Thus, it is not possible to increase the diameter of the capillaries to any desired extent in order to minimize friction, since such action would enable the molten metal to penetrate too deeply into the capillaries and block them in the event that the flow of gas should cease.

Only a large number of capillaries can guarantee the very high gas flow rate frequently desired in a steel mill. From the production angle, however, this turns out to be very expensive. Thus, to reduce friction losses, it was found advantageous to form a conical stirring plug of a single or multi-part construction to provide plural identical joints (in the case of a multi-part construction) or slots or passageways (in the case of a single part construction) extending linearly from the bottom to the top of the plug. Such "jointed/slotted" plugs exhibit similar gas agitation properties as the capillary tube plugs, but with significantly smaller pressure losses.

The joints or passageways in one type of conical "jointed/slotted" plug, such as shown in German Patent No. DE 3,538,498, are generally of arcuate shape in transverse cross-section, i.e., perpendicular to the longitudinal central axis of the conical plug, with the diameter of the arc sections decreasing linearly from the bottom of the plug to its top. This type of plug exhibits a high gas flow rate per unit of time (such as that achieved by use of a very large number of capillaries) with a small number of passageways.

In another type of conical "jointed/slotted" plug, such as shown in German Patent No. DE 3,625,117, each of the passageways is rectangular and of constant cross-section from the bottom of the plug to its top. The passageways are arranged in a radial, starburst configuration, with their longitudinal central axes being located in a cylindrical locus. This type of plug also exhibits a high gas flow rate per unit of time by use of a relatively small number of passageways. However, the radial, starburst design of the passageways leads to an undefined cracking of the passageways toward the outside edge of the plug.

Other types of prior art stir plugs are also disclosed in the following U.S. Pat. Nos.: 4 438 907 (Kimura et al.); 4,535,975 (Bührmann et al.); 4,539,043 (Miyawaki et al.); 4,560,149 (Höffgen); 4,647,020 (Leisch); 4,657,226 (Illemann et al.); 4,741,515 (Sharma et al.); 4,836,433 (Perry); 4,840,356 (Labate); 4,858,894 (Labate); 4,884,787 (Dotsch et al.); 4,898,369 (Perry); 4,899,992 (Thrower et al.) 4,905,971 (Rothfuss et al.); and 4,925,166 (Zimmermann).

Any refractory material, such as any of the foregoing stir plug devices, is subject to wear due to extreme operating conditions. As the stir plug is worn down, the longitudinal height of the plug decreases. Stir plugs must be replaced as soon as a certain critical minimal or remnant height is reached. If the stir plug is permitted to erode too much before it is replaced, a burn-out of the ladle in which the stir plug is located might occur, which is not only dangerous, but costly to replace.

Stir plugs with various devices to facilitate the determination of the critical remnant height have been generally available but with certain tradeoffs. For example, electrical indicators are generally available, but they may be expensive to install and maintain, they require an external recording apparatus and are a possible source of disturbance in an already error sensitive system.

One type of electrical indicator is the device described in the U.S. Pat. No. 4,481,809 (LaBate) which utilizes several Hall effect transducers and circuitry to monitor the output thereof.

Another electrical indicator is that disclosed in German Patent No. DE 3,424,466 (Grabner) which utilizes two electrical wires within a probe. Both ends of the wires at the tip of the probe are separated. The wires consist of an alloy that melts at the critical temperature which indicates the critical wear height. The melting alloy closes the circuit and allows an electrical current to flow from the power source.

Temperature indicators are also available, but suffer from similar drawbacks as do the electrical indicators. One such device is the one disclosed in German Patent No. DE 3,526,391 (Fischer) which utilizes a thermocouple located inside the body of a ceramic stir plug. The critical temperature inside the plug is measured to determine the critical wear height of the plug. One deficiency of this device however, is that in the event the temperature of the liquid metal destroys the thermocouple, the temperature can no longer be measured and therefore the plug may have to be prematurely replaced.

Other prior art devices measure thermal conductivity to provide an indication of the lifetime of a stir plug. For example, German Patent No. DE 3,833,503 (Rothfuss) discloses a valve configuration inside a ceramic gas stir plug. A low melting alloy keeps the gas flow valve control in the open position. Concurrent with the erosion of the stir plug, high temperatures will ultimately cause the alloy component to melt. This causes the gas flow valve to close, thus either reducing or eliminating gas flow. The reduced or discontinued gas flow indicates the stir plug wear.

Another device disclosed in German Patent No. DE 3,623,609 (Rothfuss) uses a gas flow restriction as a wear indicator. However, a gas flow restriction is not an unmistakable criterion, because a premature steel penetration of the gas passageways result in a low gas flow, thus causing a premature replacement of the stir plug.

German Patent No. DE 3,802,657 (Winkelmann) discloses a refractory wear indicator incorporated in a gas stir plug. This device is an optical indicator which makes use of the geometrical arrangement of the gas passageways situated inside the plug. A certain configuration of gas passageways inside the refractory cone separates the inner refractory portion from the outer one. The inner portion includes a round cross section at the tip of the stir cone. The round cross section changes into a square one at the bottom of the refractory cone. In use, when the metal has been tapped from the ladle and the stir plug is hooked up to a natural gas purging line, the natural gas escapes in a circle configuration from the plug. If the plug is worn down below the critical height, the configuration of the natural gas flames changes from round to square. This indicator system can only work as long as the gas passageways are free from steel. Steel penetration of the passageways prevents gas flow, thus rendering the passageways invisible.

U.S. Pat. No. 4,744,544 (LaBate et al.) describes a visual wear indicator for a metallurgical vessel that uses a metal rod which is inserted in the upper portion of a refractory body and extends inwardly of the surface of the body, at a length less than the known thickness of the refractory body. In this device, the metal rod and the refractory material therearound are elevated to the same temperature by the molten metal, but their light emission coefficients will be different whereupon the end of the rod will glow red hot while the surrounding refractory material exhibits a different color (appearance). Thus, one can readily determine if the cone has worn down beyond the length of the rod. While this wear indicator is generally suitable for its intended purposes, it still leaves much to be desired. In this regard, since the refractory plug and the steel rod of this wear indicator have different thermal expansion coefficients, elevated temperatures will result in different expansions of both materials, which action may crack the refractory body. Moreover, a faster wear of the refractory cone may occur, in part, caused by the drilling of the hole to accommodate the metal indicator. Further, the metal rod may be blown out of its hole by high gas pressure or it may prematurely melt away, thus effecting a premature plug exchange.

Accordingly, a need exists for a visual wear indicator for a gas stir plug which overcomes the disadvantages of the prior art.

OBJECTS OF THE INVENTION

It is a general object of this invention to provide a gas stir plug with a wear indicator which overcomes the disadvantages of the prior art.

It is a further object of this invention to provide a gas stir plug which is simple in construction.

It is still a further object of this invention to provide a gas stir plug which can be manufactured easily and inexpensively.

It is yet a further object of this invention to provide a gas stir plug which is effective in operation.

It is yet still another object of this invention to provide a gas stir plug device which has a visual wear indicator which is simple in construction and reliable.

SUMMARY OF THE INVENTION

These and other objects of this invention are achieved by providing a stirring plug for introducing gas into a mass of molten metal.

The stirring plug is generally frusto-conical in shape, has a central longitudinal axis and a top and bottom end. The plug is composed of an outer core formed of a first refractory material extending between its top and bottom end. The outer core includes a recess centered on the longitudinal axis adjacent the bottom end of the plug. A central core of a second refractory material is located within the recess and extends in a direction from the bottom end of the plug towards the top end of the plug and is of a predetermined height. The central core is arranged to have a stirring gas pass therethrough during use of the stirring plug. The central core is arranged to be exposed when the plug has worn away to a predetermined point to provide a visual indication that the plug should be replaced.

BRIEF DESCRIPTION OF THE DRAWINGS

Other objects and many attendant features of this invention will become readily appreciated as the same becomes better understood by reference to the following detailed description when considered in connection with the accompanying drawing wherein:

FIG. 1 is a front elevational view, partially in section, of one embodiment of a stir plug constructed in accordance with this invention;

FIG. 2 is a top plan view of the stir plug shown in FIG. 1;

FIG. 7 is an isometric view of an alternative embodiment of the central core of the stir plug of the present invention.

DETAILED DESCRIPTION OF THE PREFERRED EMBODIMENTS

Figure 3:
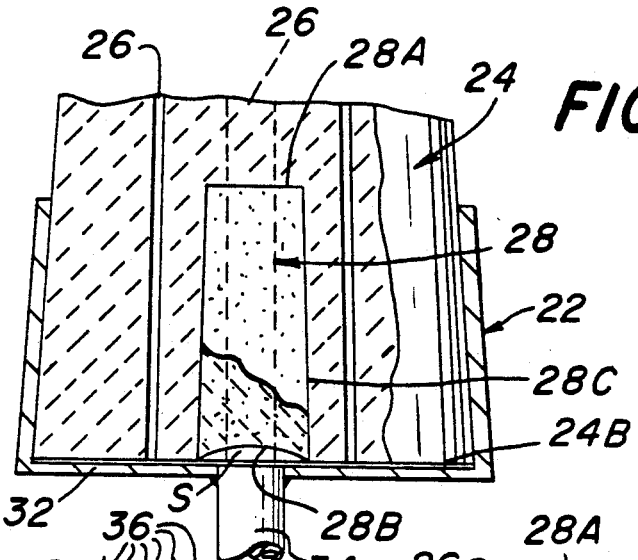
FIG. 3 is a front elevational view, partially in section, of a second embodiment of a stir plug constructed in accordance with this invention.

Referring now to various figures of the drawing where like reference numerals refer to like parts, there is shown in FIG. 1, one embodiment of a stir plug 20 constructed in accordance with this invention. The stir plug 20 is constructed generally in accordance with the teachings of U.S. patent application Ser. No. 07/583,058 filed on Sep. 14, 1990, entitled Gas Stir Plug With Slots And Method Of Making The Same, now U.S. Pat. No. 5,104,097 assigned to the same assignee as this invention and whose disclosure is incorporated by reference herein. Thus, the stir plug 20 basically comprises a frusto-conically shaped shell or outer surface 22 having a frusto-conically shaped dense outer core or plug 24 located therein. A plurality of passageways or slots 26 extend through the plug 24 for transporting a stirring gas through the plug from its bottom end or surface 24B to its top end or surface 24A, as will be described later. Unlike the stir plug of the aforementioned patent application, the stir plug 20 of this invention includes a visual wear indicator. The wear indicator basically comprises a central core 28 of a refractory material within the outer core 24. The details of the wear indicator 28 will be described later.

The shell 22 is preferably formed of any suitable material, such as stainless steel, a fired ceramic or a ceramic coated metal. The shell includes a generally planar bottom wall 32 having an inlet port or conduit 34, into which any suitable stirring gas 36 may be introduced in the direction of the arrow, and a peripherally extending conical side wall 38 terminating at its upper end in an opening 40.

The outer core or plug 24 is formed of any suitable refractory material, e.g., it is a dense, non-permeable ceramic material, and is shaped to closely fit within the interior of the shell or outer surface 22. The sidewall 38 of the shell may extend only partially, e.g., from one third to one half, the height of the plug or may extend the full height of the plug (not shown).

The plug 24, being of frusto-conical shape, includes a conical outer surface 42 extending between the top surface 24A and the bottom surface 24B and about the central longitudinal axis 44 of the plug 20. The bottom and top surfaces of the plug are each substantially planar and are disposed perpendicularly to the central longitudinal axis 44 of the plug.

As can be seen in FIGS. 1–6, there are preferably four slots 26 in the outer core or plug 24. The slots 26 are disposed in a frustum-shaped array about the central longitudinal axis 44 of the plug between its top surface 24A and its bottom surface 24B. The slots serve to carry a stirring gas 36 introduced into the plug via conduit 34, out through the top end of the plug, to stir molten metal in the vessel (not shown), in which the stir plug 20 is located.

Preferably the walls forming the periphery of the slots are smooth so that each slot can transport gas therethrough with low frictional loss from the bottom of the plug to its top. Moreover, the slots are configured to minimize the danger of slot blockage caused by the intrusion and freezing of the metal in the slot as the plug wears down should the flow of gas therethrough become interrupted or terminated.

It must be pointed out that the number, size and orientation of the slots 26 shown is merely exemplary. Moreover, the spacing of the slots radially, i.e., the distance of the slots from the outer surface 42 of the plug, can be any desired value depending upon the size of the plug itself. However, it is preferred that the distance between each slot and the outer surface of the plug immediately adjacent thereto at the top of the plug be smaller than that distance at the bottom of the plug. In one typical embodiment, the radial distance between any slot at the top of the plug and the plug's outer surface may be in the range of 5.0 mm to 40 mm, whereas the radial distance between any slot at the bottom of the plug and the plug's outer surface may be in the range of 30 mm to 100 mm.

As will be appreciated by those skilled in the art, utilizing slots arranged in a frustum array causes the plugs to be resistant to any cracking which may propagate to the surface of the plug. Moreover, the spacing of the slots vis a vis one another, decreases from the bottom of the plug to its top, whereupon the nominal fracture location tends to occur at the top of the plug rather than at its bottom.

Referring now to FIG. 1, the details of one embodiment of the visual wear indicator 28 of the present invention will be considered. As can be seen that wear indicator basically comprises a generally frusto-conically shaped central core 28, located within a corresponding recess 24C centered about the central longitudinal axis 44 of the plug 24 at the bottom end thereof. The bottom end 28B of the central core 28 is generally flush with the bottom end 24B of the outer core 24 and is spaced slightly above the inner surface of the bottom wall 32 of the sleeve to be in fluid communication with conduit 34. As seen in FIG. 7, the central core 28 (wear indicator) may alternatively be truncated pyramidal shape 48 or rectangular or almost any other polygonal shape. The central core 28 is formed of the same refractory material as the outer core 24 but is considerably less dense (i.e., it is porous) to enable gas to flow therethrough (as will be described later).

Figure 6:
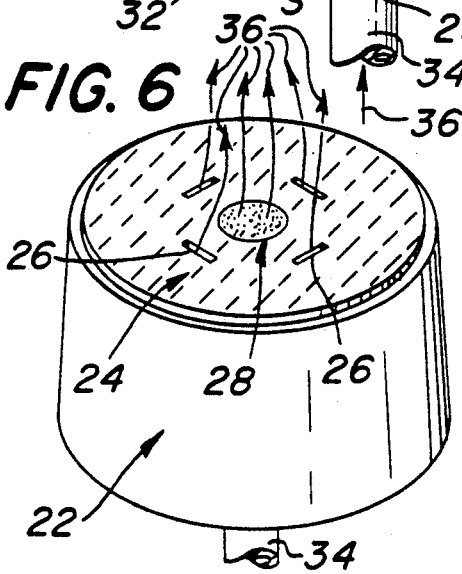
FIG. 6 is an isometric view of the stir plug of the present invention shown in an eroded or worn condition with the upper end of the visual wear indicator indicating the replacement of the gas stir plug is desirable.

The longitudinal length of the central core 28, i.e., its dimension measured along the central longitudinal axis 44 of the plug, is selected so that its upper end 28A is located at the critical wear height or elevation of the plug 20. As seen in FIG. 6, when the dense outer core 24 is eroded or worn down during use to the critical wear height, the upper end 28A of the central core 28 will become exposed and visible. At this time, stirring gas 36 which doesn't flow through the slots 26 will flow through the central core 28 and out its now exposed top surface 28A and very little, if any, gas will flow through the outer core. Thus, gas 36 passing through the central core 28 rapidly cools it down to a temperature in the range of 700° to 1,400° F., while the outer core 24 remains substantially hotter, e.g., 2,200° F. Accordingly, the cooler central core 24 will appear as a readily visible dark spot centered within a brighter area, i.e., the hotter surrounding (outer) core 24. This appearance of the dark spot within a bright area indicates that the stir plug 20 should be replaced to avoid the burning out of the ladle or other metallurgical vessel (not shown).

In the embodiment shown in FIGS. 1 and 6, the central core is 100–170 mm in height, and preferably in the range of 130–150 mm in height. In addition, the central core may have a diameter of approximately 20–60 mm at the top and 30–75 mm at the bottom, and preferably 30–40 mm at the top and 40–50 at the bottom. It should be understood that these dimensions are merely exemplary and are not meant to limit the dimensions of the central core which may be of various dimensions depending upon the circumstances of use.

The porous structure of the inner core assures bubble readiness at all times due to the huge amount of undisturbed pores. A conventional chemical, chemical-ceramic and/or ceramic bonding system prevents the inner core from being separated from or blown out of the outer core. Since the porous inner core and the outer core are both made of the same refractory base material, no internal stresses can build up, otherwise resulting if the inner and outer cores are made from materials which have a different coefficient of expansion. Further protection against separation or blow out of the inner and outer cores is also provided by the slightly tapered geometric shape of the inner core, whether it be formed in a frusto-conical, pyramidal, polygonal or other shape.

A second preferred embodiment of the wear indicator is shown in FIG. 3 and is substantially the same as the embodiment shown in FIG. 1, except that the bottom end 28B of the central core 28, is concave to create a domed space S between the lower end 28B and the upper surface of the bottom wall 32 of the shell 22. This space S acts as a gas distribution chamber within the stir plug.

Figure 4:
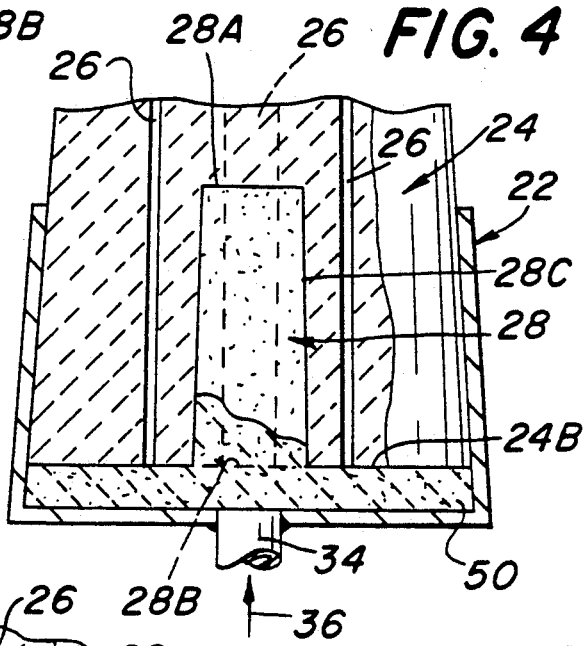
FIG. 4 is a front elevational view, partially in section, of third embodiment of a stir plug constructed in accordance with this invention.

A third preferred embodiment of a stirring plug with a wear indicator is shown in FIG. 4. That plug 20 additionally comprises an interface plate 50 formed as an integral unit with the central core 28 and located above the upper surface of the bottom wall 32 of the shell 22. Thus, interface plate 50 is comprised of the same porous refractory material as the central core 28. The purpose of the interface plate 50 is to prevent molten steel, which may unintentionally penetrate the slots 26, from dripping out of the stir plug. The interface plate 50 also acts to distribute gas 36 to the slots 36 within the device. Thus, the porous material of the interface plate 50 is in fluid communication with the port 34 and the slots 26 to aid in distributing the gas. However, the slots 26 do not extend into or through the interface plate.

Figure 5:
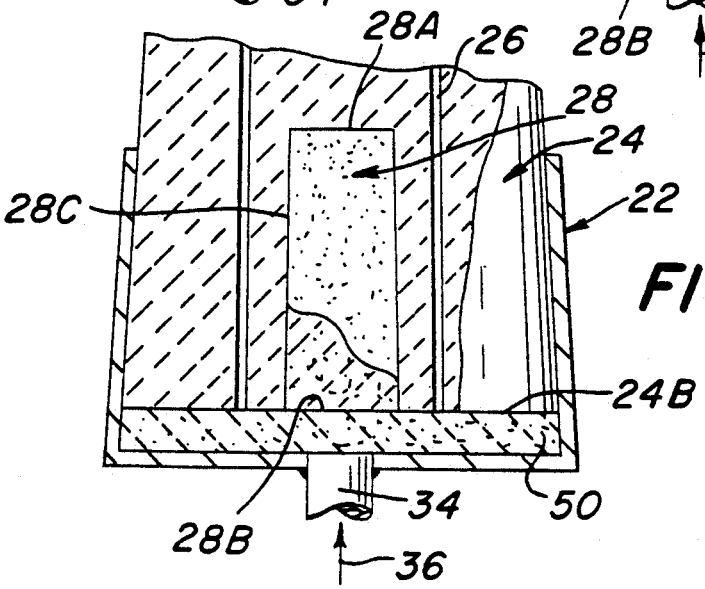
FIG. 5 is a front elevational view, partially in section, of a fourth embodiment of a stir plug constructed in accordance with this invention.

A fourth preferred embodiment of a stirring plug with a wear indicator is shown in FIG. 5. That plug 20 is similar to the embodiment of FIG. 4, except that the interface plate 50 is not integrally formed with the bottom end 28B of the central core. Instead it is a separate member located immediately below the bottom surface 28B of central core 28 and the bottom surface 24B of the outer core 24. Additionally, as in the embodiment shown in FIG. 4, the slots 26 do not extend into or through the interface plate.

Without further elaboration the foregoing will so fully illustrate our invention that others may, by applying current or future knowledge, adapt the same for use under various conditions of service.

We claim:

1. A device for introducing gas into a mass of molten metal comprising a plug of a generally frusto-conical shape which is worn away during use, said plug comprising;

(a) a central longitudinal axis;
(b) a top end;
(c) a bottom end;
(d) a shell;
(e) an outer core located within said shell and comprised of a first refractory material extending between said bottom end and said top end, said outer core being a one-piece member having a recess of a predetermined height centered on said longitudinal axis located adjacent said bottom end so that a top portion of said one-piece member is disposed directly over said recess.
(f) a passageway extending between said bottom end and said top end of said outer core through which said gas is passed from said bottom end to said top end to exit therefrom; and
(g) a central core having an upper end and a lower end and being located within said recess and below said top portion of said one-piece member of said outer core, said central core being a one-piece member of a height equal to the predetermined height of said recess to completely fill said recess and comprised of a generally porous second refractory material, said central core being arranged to be exposed when said plug has worn away to a predetermined point, whereupon said gas from said passageway commences flowing through said central core and provides a visual indication that said plug should be replaced.

2. The device of claim 1 wherein the plug additionally comprises a gas entry port in fluid communication with the central core.

3. The device of claim 1 wherein the plug additionally comprises an interface plate located between the central core and the bottom end of the plug.

4. A device for introducing gas into a mass of molten metal comprising a plug of a generally frusto-conical shape which is worn away during use, said plug comprising;

(a) a central longitudinal axis;
(b) a top end;
(c) a bottom end;
(d) An outer core comprised of a first refractory material extending between said bottom end and said top end, said outer core having a recess centered on said longitudinal axis located adjacent said bottom end;
(e) a central core having an upper end and a lower end and being located within said recess, said central core being of a predetermined height and comprised of a generally porous second refractory material, through which a gas is passed, said central core being arranged to be exposed when said plug has worn away to a predetermined point to provide a visual indication that said plug should be replaced; and
(f) an interface plate located between said central core and said bottom end of said plug, said interface plate being comprised of the generally porous refractory material.

5. A device for introducing gas into a mass of molten metal comprising a plug of a generally frusto-conical shape which is worn away during use, said plug comprising;

(a) a central longitudinal axis;
(b) a top end;
(c) a bottom end;
(d) an outer core comprised of a first refractory material extending between said bottom end and said top end, said outer core having a recess centered on said longitudinal axis located adjacent said bottom end;
(e) a central core having an upper end and a lower end and being located within said recess, said central core being of a predetermined height and comprised of a generally porous second refractory material, through which a gas is passed, said central core being arranged to be exposed when said plug has worn away to a predetermined point to provide a visual indication that said plug should be replaced, said central core additionally comprising a bottom end having a generally concave surface.

6. The device of claim 4 wherein the interface plate and the central core comprise an integral unit.

7. The device of claim 1 wherein the cross section of the central core taken in a direction generally perpendicular to the central longitudinal axis thereof is a regular geometric shape.

8. The device of claim 1 wherein the central core and the outer core are fixedly secured together.

9. The device of claim 1 wherein said first and second materials have substantially the same thermal expansion coefficient.

10. The device of claim 8 wherein said first and second materials have substantially the same thermal expansion coefficient.

11. A device for introducing gas into a mass of molten metal comprising a plug of a generally frusto-conical shape which is worn away during use, said plug comprising;

(a) a central longitudinal axis;

(b) a top end;

(c) a bottom end;

(d) An outer core comprised of a first refractory material extending between said bottom end and said top end, said outer core having a recess centered on said longitudinal axis located adjacent said bottom end and plural slots therein for carrying gas therethrough between the bottom end and the top end of the plug;

(e) a central core having an upper end and a lower end and being located within said recess, said central core being of a predetermined height and comprised of a generally porous second refractory material, through which a gas is passed, said central core being arranged to be exposed when said plug has worn away to a predetermined point to provide a visual indication that said plug should be replaced.

12. The device of claim 1 wherein said plug is located within a metal shell.

* * * * *